United States Patent [19]

Oleson

[11] Patent Number: 4,888,831

[45] Date of Patent: Dec. 26, 1989

[54] ADJUSTABLE HEAD BAND SUSPENSION SYSTEM FOR USE WITH HARD HAT SHELL

[75] Inventor: Richard A. Oleson, Lexington, Ky.

[73] Assignee: E. D. Bullard Company, Sausalito, Calif.

[21] Appl. No.: 204,742

[22] Filed: Jun. 10, 1988

[51] Int. Cl.[4] ..... A42B 1/22; A42B 3/02

[52] U.S. Cl. ..... 2/420; 24/584; 24/664

[58] Field of Search ..... 2/416, 417, 418, 419, 2/420; 24/580, 584, 585, 664, 665, 672

[56] References Cited

U.S. PATENT DOCUMENTS

| | | | |
|---|---|---|---|
| 3,221,340 | 12/1965 | Joffe | 2/417 |
| 3,555,560 | 1/1971 | Rascke | 2/416 |
| 3,605,113 | 9/1971 | Marietta | 2/420 |
| 3,696,441 | 10/1972 | Littleton | 2/418 |
| 3,711,864 | 1/1973 | Dickstein | 2/416 |
| 3,950,788 | 4/1976 | Lamb | 2/417 |
| 4,292,692 | 10/1981 | Moretti et al. | 24/585 X |

FOREIGN PATENT DOCUMENTS

| | | | |
|---|---|---|---|
| 962001 | 2/1975 | Canada | 2/417 |
| 712161 | 9/1931 | France | 24/585 |
| 1528647 | 10/1978 | United Kingdom | 2/416 |

*Primary Examiner*—Wm. Carter Reynolds
*Attorney, Agent, or Firm*—Maurice L. Miller, Jr.

[57] ABSTRACT

An adjustable head band suspension system for use in a safety hat shell is disclosed. The suspension system includes a head encircling head strap having overlapping rear end portions and an arc shaped channel adapted to fit the back of a wearer's head. The overlapping end portions of the head strap are slidably disposed in the channel. A suitable adjusting device, such as a rack and pinion or buckle is attached to the channel to adjust the amount of overlap of the end portions. The channel is attached by means of a pair of tabs to a rear interior surface portion of the shell and a front end portion of the head strap is connected to a forward interior surface portion of the shell. A manually compressible, resilient buckle assembly is disclosed which can be used by itself for adjusting and maintaining the desired length of overlap of the overlapping end portions of a head strap or which can be used in association with the arc shaped channel as a central portion thereof.

21 Claims, 2 Drawing Sheets

ADJUSTABLE HEAD BAND SUSPENSION SYSTEM FOR USE WITH HARD HAT SHELL

BACKGROUND OF THE INVENTION

This invention relates generally to adjustable, flexible strap suspension systems used in hard hat shells.

More specifically, this invention relates to means for adjusting the width of such a suspension system to fit heads of varying size without causing the vertical centerline of the system to shift away from the vertical centerline of the shell. Adjustable head band suspension systems for use in hard hat shells have, generally speaking, long been known in the prior art. U.S. Pat. No. 3,555,560 issued to H. A. Raske on Jan. 19, 1971 discloses one of many such examples. The reference system employs two diagonally extending crown straps which cross one another over the top of the wearer's head and connect on rear end portions thereof to two tabs located on rear end portions of a head encircling head strap. Forward end portions of the diagonally extending crown straps connect to two tabs formed on a brow pad at the front of the system. Forward end portions of the head strap contain a series of pin holes, any one of which can be selected for engagement with pins located on opposite side end portions of the brow pad.

The Rascke system presents two difficulties typically encountered in head band systems of the prior art. First, adjustments of the head encircling strap to fit heads of varying size must be made near the forward ends of the head strap on opposite side end portions of the brow pad where the spacing between the head strap and brim of the hard hat shell is quite narrow. Second, care must always be taken to always make equal adjustments in both ends of the head strap in order to maintain the suspension system centered in the shell.

U.S. Pat. No. 3,500,474 issued to H. W. Austin on Mar. 17, 1970 discloses one of many prior art safety hat suspension systems which are adjustable at the rear of the shell. The reference system employs a head encircling head strap having overlapping rear end portions which are adjustable directly between two points of attachment of the head strap to a rear end portion of the shell. As such, the reference system avoids the first mentioned difficulty encountered in the Rascke system, but introduces another problem in that adjustments of the head strap can only be made directly between the two attachment points of the strap on the rear end portion of the shell. The much longer remaining portion of the strap extending from the two rear attachment points along the sides and around the front of the head are substantially unaffected by such rear end adjustments. As a result, when using the Austin type system, the adjustments for smaller size heads will cause the head to become decentered and shift toward the front of the shell, while adjustments for larger sized heads will cause the head to decenter and shift toward the rear of the shell. Also, when the rear end portions of the head strap of Austin are sufficiently loosened between the rear shell attachment points in order to fit larger sized heads, the shell can become floppy and unstable on the head of the wearer.

Accordingly, by means of the present invention, these and other problems encountered with prior art safety hat suspension systems are substantially reduced if not altogether eliminated.

SUMMARY OF THE INVENTION

It is an object of my invention to provide a novel adjustable hard hat suspension system.

It is another object of my invention to provide an adjustable hard hat suspension system wherein adjustments to the width of the suspension system can readily and conveniently be made by adjustment at the back of the wearer's head.

It is yet another object of my invention to provide an adjustable hard hat suspension system wherein a large portion of the circumference of the system can be adjusted through a range of distances without shifting the suspension system off the vertical centerline of the shell.

It is also an object of my invention to provide novel means for adjusting and maintaining the desired length of overlap between overlapping rear end portions of a head encircling strap of the system.

It is an additional object of my invention to provide a novel means for adjusting and maintaining the desired length of overlap between overlapping rear end portions of the head strap through a substantial range without creating variation in the load path between two points of connection of a rear end portion of the head strap to adjacent interior surface portions of the hard hat shell.

It is still another object of my invention to provide a novel, manually compressible, resilient buckle for adjusting and maintaining the length of overlap of overlapping rear end portions of a head strap portion of a hard hat suspension system.

Briefly, in accordance with my invention, there is provided in combination with a safety hat shell, an adjustable head band suspension system which includes a head encircling head strap having overlapping rear end portions. An arc shaped channel adapted to conform to the back of a wearer's head is also provided wherein the overlapping end portions are slidably movable. Means for connecting the channel to a rear end portion of the shell and means for connecting a forward end portion of the head strap to a forward end portion of the shell are also provided. Lastly, a means is connected to the channel for adjusting and maintaining a desired length of overlap of the overlapping end portions.

These and other objects, features and advantages of the present invention will become apparent to those skilled in the art from the following detailed description and attached drawings upon which, by way of example, only the preferred embodiments of my invention are described and illustrated.

DESCRIPTION OF THE PREFERRED EMBODIMENT

Figure 1:
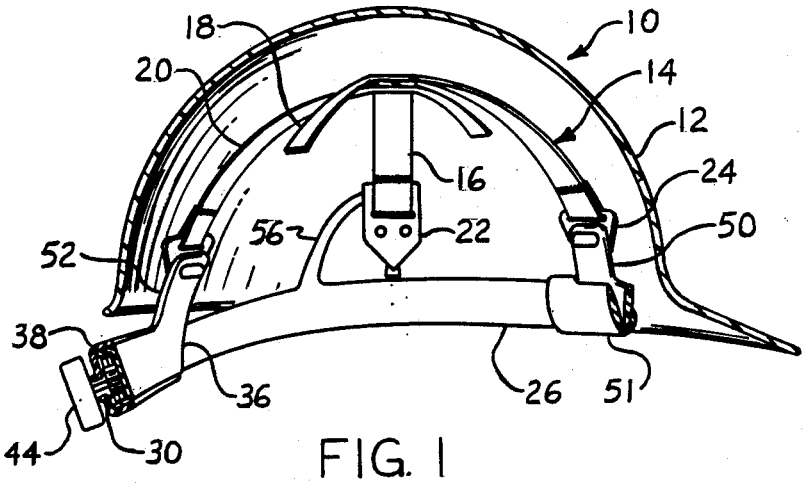
FIG. 1 shows a cross-sectional side elevation view of a hard hat shell and an adjustable head band therefor, thus illustrating one preferred embodiment of my invention.

Referring now to the drawing figures, there is shown, in one preferred embodiment of my invention, a safety or hard hat 10 of the type which includes a rigid shell 12 made of plastic, fiberglass, metal or other suitable material, and a headband suspension system or assembly 14 connected to interior surface portions of the shell 12. The assembly 14 includes flexible crown straps 16, 18 and 20 which cross one another over the top of the wearer's head and connect on end portions thereof by means of connector clips 22 and 24 to connector clip sockets 25 formed on and spaced around the interior surface of the shell 12. The assembly 14 also includes a flexible head strap 26, preferably constructed of a suitable plastic, which is adapted to encircle the head of the wearer, and which is connected by way of the connector clips 22 and 24 to the various crown straps 16, 18 and 20 and to the various sockets 25 on the shell 12. The head strap 26 is preferably of one piece construction and contains slidably adjustable overlapping rear end portions 28 at the rear thereof. The assembly 14 further contains means for adjusting the amount of overlap of the end portions 28 which, in the present example, includes a rack and pinion adjusting mechanism 30 of well known type adapted to operate within elongated overlapping slots 32 of the end portions 28 and engage a series of the teeth of rack gear 34.

The adjusting mechanism 30 and the overlapping end portions 28 are housed between a pair of adjoining arc shaped channels 36 and 38 which may also be made of plastic so as to conform more or less to the contour of the back of the wearer's head. Specifically, the overlapping end portions 28 are seated for slidable engagement on and along the broad curved surface of the channel 36 between upper and lower ledges 40 thereof. In turn, the ledges 40 are confined between upper and lower ledges 42 of the channel 38 in close fitting relationship. Adjustment of the head strap 26 to tighten or loosen the same is thus readily accomplished in the usual, well known manner by clockwise and counterclockwise rotation of a knob 44 located below the rear rim of the shell 12 behind the wearer's head.

Connection of the connector clips 22 and 24 to the sockets 25 located on or around the interior surface of the shell 12 is conventional. In the present example, the clips 22 and 24 may be made of plastic, to include dovetail joints 46 which fit into the sockets 25 in a well known manner so that, while the crown straps 16, 18 and 20 lie directly over the wearer's head, the shell is elevated so as not to touch the head of the wearer under ordinary conditions. End portions of the crown straps 16, 18 and 20 are inserted through slots in the connector clips 22 and 24 and are folded back upon the outer surface of the corresponding straps where they are fastened as by stitching 48.

On the other hand, connection of the diagonally extending crown straps 18 and 20 through the connector clips 24 to the head strap 26 is a novel feature in that the path between the two adjacent connection points through the head strap 26 at the rear end of hat 10 remains constant with and independent of adjustment of the overlapping ends 28 of the head strap 26. As a consequence, the crossover point of the crown straps 16, 18 and 20 remains centered over the head strap 26 throughout the entire range of adjustment of the head strap 26. This is accomplished at the forward end of assembly 14 by direct attachment of the head strap 26 at two positions symmetrical with respect to the longitudinal centerline of the hat 10 through two of the connectors 24 to the shell 12 and at the rear end of the assembly 14 by direct attachment of the channel 36 at two positions symmetrical with the centerline through the remaining two connectors 24 to the shell 12.

Figure 2:
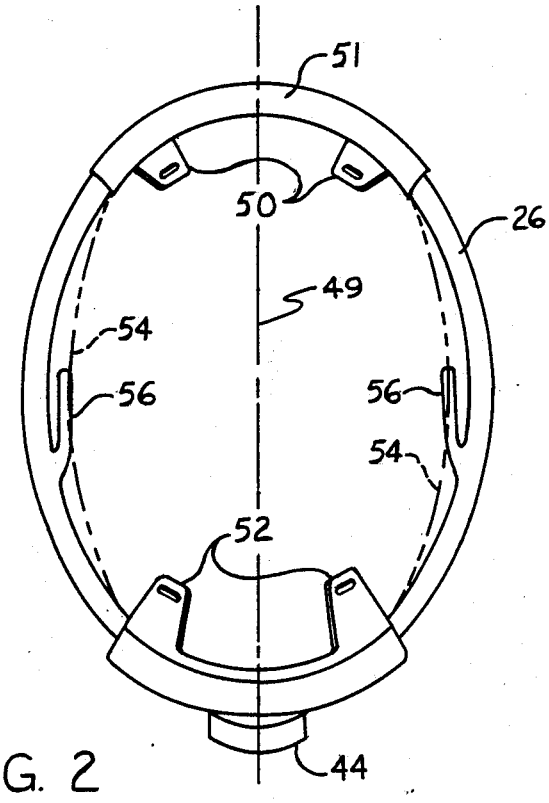
FIG. 2 shows an inverted plan view of the adjustable head band of FIG. 1 with the hard hat shell removed, illustrating the lateral adjustability of the head band.

Specifically, a pair of spaced apart tabs 50, which may be made of plastic, are integrally connected to upper edges of the head strap 26 and extend upwardly through an absorbent brow pad 51. The tabs 50 are located symmetrically with respect to the centerline 49 of the assembly 14 on either side thereof, the upper ends of which are attached in a suitable manner to the two forwardly positioned connector clips 24. Similarly, a pair of spaced apart tabs 52, which may be integrally formed on opposite end portions of the channel 36 extend upwardly to make connection in a suitable manner with the two connector clips 24 located at the rear of the assembly 14. It will thus be appreciated that the spacing between the tabs 50 at the front of the assembly 14 and the spacing between the tabs 52 on the channel 36 at the rear of the assembly 14 will be unaffected by the slidable movement of the overlapping end portions 28 during adjustment of the head strap 26. As shown in FIG. 2, the sides of the head strap 26 can be adjusted inwardly, from an expanded position as shown in full to a contracted position as indicated by dashed lines 54, without affecting the positions of the tabs 52.

Figure 4:
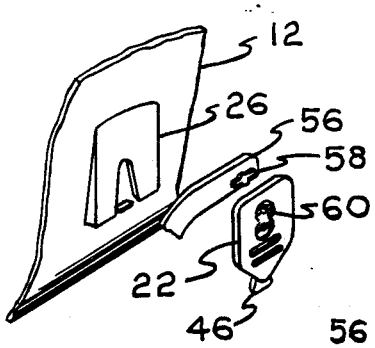
FIG. 4 shows an exploded perspective view of a fragment of one side of the hard hat shell of FIG. 1 illustrating the connection of the interior surface of the hard hat to a transverse extending crown strap of the head band of FIGS. 1–3.
Figure 3:
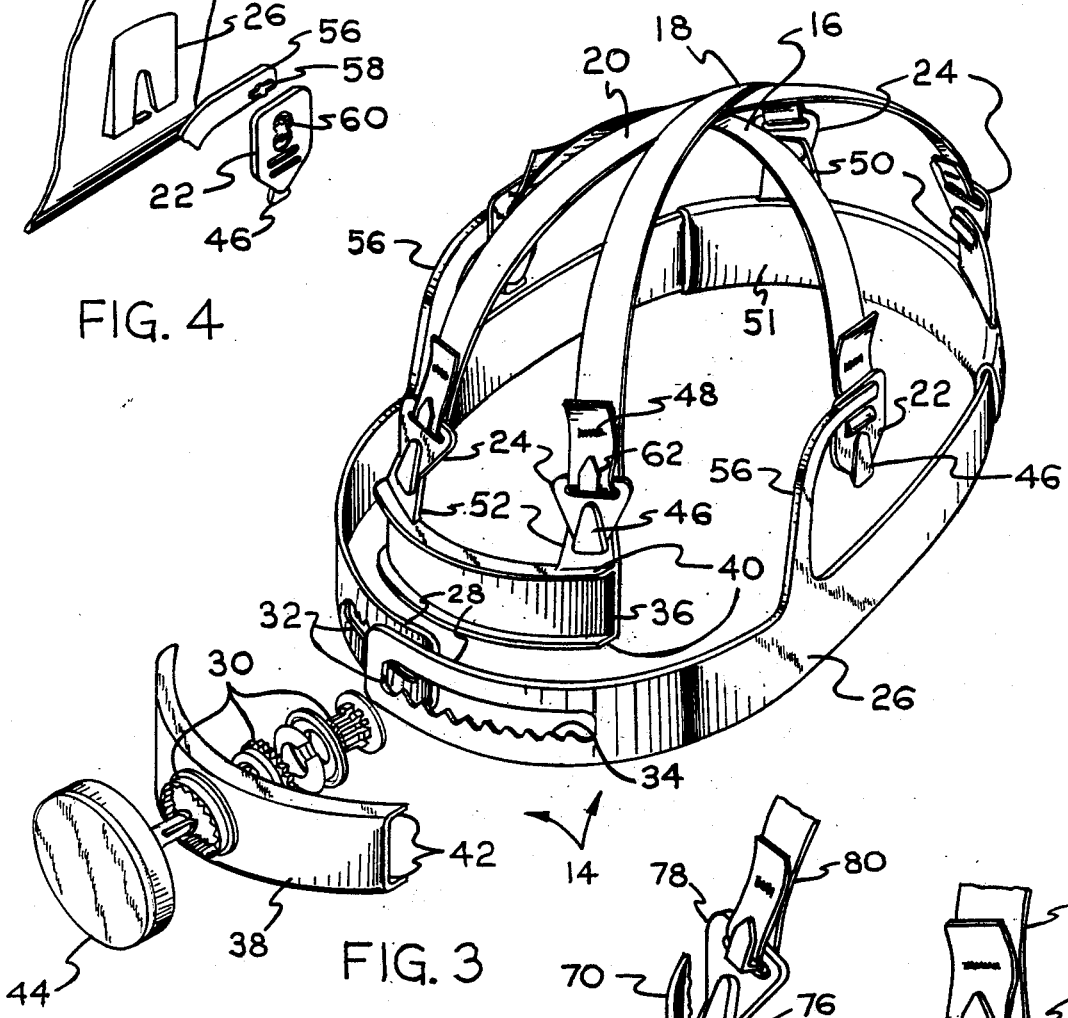
FIG. 3 shows a partially exploded perspective view of the adjustable head band of FIGS. 1–2 as viewed from a rearward position.
Figure 5:
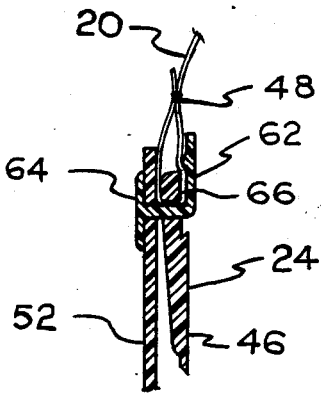
FIG. 5 shows a cross-sectional side elevation view of a connector clip used to connect a rear end portion of one of a pair of diagonally extending crown straps to an interior surface portion of the hard hat shell.

In those hard hats which utilize a transverse extending crown strap, such as the strap 16 of the present example, means may be provided for joining the same to the head strap 26 so that the strap 16 need not be shipped separately and perhaps lost, while at the same time allowing for sideways or lateral (inward and outward) adjustment of the head strap 26. This is accomplished in the present example in a conventional manner by means of a pair of flexible pigtails or extension elements 56 which are connected to opposite sides of the head strap 26. The elements 56 contain a button or key 58 adapted for connection through openings 60 in the connector clips 22 (FIG. 4 only). The elements 56 should be of sufficient length to allow the sides of the head strap 26 to adjust inwardly and outwardly through the full range of adjustment of the adjusting means 30 without being drawn tight. The connector clips 24 are likewise conventional and, as shown most clearly in FIG. 5, utilize a right angularly shaped pin 62 having a button 64 on one end thereof which inserts through a slot 66 through which the diagonal crown straps 18 and 20 also extend. The pins 62 thus tightly confine the diagonal crown straps 18 and 20 in the slots 66.

It will be recognized that other means for adjusting the overlapping end portions 28 of the head strap 26 other than the rack and pinion type adjusting means 30 of the present example may be employed in association with a bracket or channel such as the channel 36 in order to permit adjustment of the strap 26 without affecting the distance between the tabs 52 such that the adjusting mechanism 30 is exemplary only.

Figure 6:
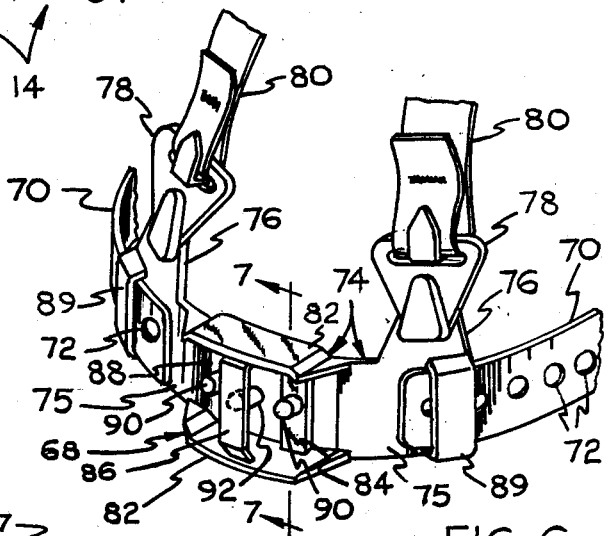
FIG. 6 shows a perspective view of an alternative means for adjusting an adjustable head band of a hard hat shell, thus illustrating another embodiment of my invention.
Figure 8:
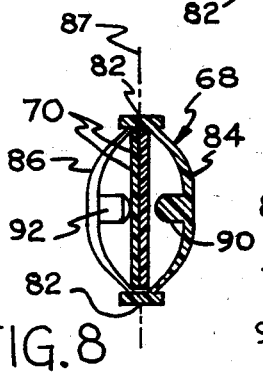
FIG. 8 shows the adjusting means of FIGS. 6–7 in a compressed condition necessary for adjustment of the head band.
Figure 7:
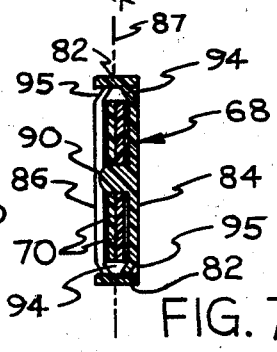
FIG. 7 shows a cross-sectional fragment of the adjusting means of FIG. 6 as viewed along cross-section lines 7—7 of the latter figure, said adjusting means being in a relaxed, uncompressed condition.

One alternative example of such an adjusting means is a novel, quick release, manually compressible, resilient buckle arrangement 68 as shown in FIGS. 6–8. The buckle 68 is adapted for use with an adjustable head strap having overlapping rear end portions 70 which define a series of spaced pin holes 72. The buckle 68 may be made of plastic and used by itself to adjust and maintain the head strap or it may be integrally formed as a central portion of an arc shaped plastic channel 74 connected between opposite end portions 75 of the channel as shown in the present example. The channel 74 is adapted to fit the back of the wearer's head similar to the channel 36 of the previous example. A pair of spaced apart tabs 76 is integrally formed on the upper edges of opposite end portions of the channel 74 and extends upwardly therefrom to connect to a pair of conventional connector clips 78. The clips 78 are, in turn, connected to rear end portions of a pair of diagonally extending crown straps 80 and interior surface portions of a hard hat shell (not shown), all in the same manner as illustrated in the previous example.

The buckle 68 includes flexible, resilient upper and lower ledges 82 and flexible, resilient, bands 84, 86 and 88 which extend between the ledges 82. The ledges 82 depend from upper and lower edges of the channel end portions 75. The opposite end portions 70 of the head strap are inserted through belt loops 89 formed on opposite ends of the channel end portions 75 and are brought together in overlapping relation between the bands 84 and 88 located on an inner side thereof, and the band 86 which is located on an outer side thereof. As shown in FIG. 7, the bands 84 and 88 are spaced inwardly from the vertical centerline 87 of the ledges 82 while the band 86 is spaced outwardly from the centerline. The bands 84 and 88 each contain a pin 90 which projects rearwardly away from the channel end portions 75 which are spaced apart by an amount equal to the distance between any three successive holes 72. The band 86 is centrally located longitudinally between the bands 84 and 88 and contains a pin 92 which projects forwardly toward the channel 74 and which is spaced from each of the pins 90 by an amount equal to the distance between two successive holes 72. The widthwise spacing of the bands 84 and 88 on one side of the vertical centerline 87 of the ledges 82 and of the band 86 on the other side thereof is such that the overlapping end portions 70 will fit between the band 86 and the bands 84 and 88 when the buckle is in a relaxed, uncompressed state as shown in FIGS. 6–7.

After insertion of the opposite end portions 70 of the head strap into the belt loops 89, the end portions 70 are guided between the bands 84 and 88, on the inner side thereof, and the band 86, on the outer side thereof, for engagement with the pins 90 and 92. The ledges 82 are squeezed or compressed toward one another on central portions thereof with the thumb and forefinger to force the bands 84, 86 and 88 to bend outwardly so that the overlapping ends 70 can be inserted therebetween and clear the ends of the pins 90 and 92 in the manner shown in FIG. 8. Upon alignment of one set of registered holes 72 of the overlapping ends 70 with the pins 90 and 92, the ledges 82 are released to allow the pins to engage opposing pin holes 72 to thus lock the overlapping ends 70 in place in the buckle 68 as indicated in FIG. 7. The buckle 68 is readily released from engagement with the overlapping ends 70 by again squeezing the ledges 82 toward one another to bend the bands 84, 86 and 88 outwardly to withdraw the pins 90 and 92 from engagement in the holes 72, while the end portions 70 are further adjusted inwardly or outwardly of the buckle 68. The bands 84 and 88 should each preferably be only about one-half as stiff as the band 86 so that all will bend equally when the ledges 82 are compressed. This can be accomplished in several different ways as, for example, by molding the bands 84 and 88 so as to be only about one-half the thickness of the band 86.

The relaxed, normal position of the buckle 68 is shown in FIG. 7 wherein there exist small gaps or spaces 94 between the upper and lower ledges 82 and upper and lower edges of the overlapping end portions 70. These gaps 94 are necessary in order to permit central portions of the ledges 82 to be depressed so as to cause outward bending of the bands 84, 86 and 88 as illustrated in FIG. 8 wherein the gaps 94 of FIG. 7 have disappeared. Notice also in FIG. 7 that upper and lower end portions 95 of the bands 84, 86 and 88 are bent inwardly at an angle toward the vertical centerline 87 of the ledges 82 to insure that they will always bend outwardly away from the vertical centerline 87 when the ledges 82 are compressed. This will assure that the pins 90 and 92 will always be removable from the holes 72 to allow adjustment in the end portions 70 of the headstrap when the ledges 82 are compressed.

In the present example, as well as in the previous example, adjustment of the overlapping end portions 70 of the headstrap can be made easily within and along the channel 74 without tending to pull the tabs 76 toward one another or otherwise cause the vertical centerline of the head band assembly to shift away from the vertical centerline of the hard hat shell in which the assembly is employed. Thus, the head of the wearer will remain essentially centered within the hemisphere of a hard hat shell in which the adjustable head band is employed throughout a reasonable range of adjustments of the sides of the head straps inwardly and outwardly. As was the case in the previous example, the adjustment means of the present example can be employed on a head band having adjustable overlapping end portions and diagonally extending crown straps with or without a transversely extending crown strap.

Although the present invention has been described with respect to specific details of certain preferred embodiments thereof, it is not intended that such details limit the scope of the present invention otherwise than as specifically set forth in the following claims.

I claim:

1. In combination with a safety hat shell, an adjustable head band suspension system comprising a head encircling head strap having overlapping rear end portions, an arc shaped channel adapted to conform to the back of a wearer's head, said overlapping end portions being slidably movable along said channel, means separate and detached from said head strap for connecting said channel to a rear end portion of said shell, means for connecting a forward end position of said head strap to a forward end portion of said shell, and means connected to said channel for adjusting and maintaining a desired length of overlap of said overlapping end portions.

2. The suspension system of claim 1 wherein said adjusting and maintaining means comprises a buckle forming a central portion of said channel connected between opposite end portions of said channel, said buckle being removably connectable to said overlapping end portions.

3. The suspension system of claim 1 wherein said means for connecting said channel to a rear end portion of said shell comprises a pair of spaced apart tabs connected to opposite end portions of said channel so as to be symmetrical about the longitudinal centerline of a wearer's head.

4. The suspension of system of claim 1 wherein said head strap connecting means comprises a pair of spaced apart tabs connected to a forward end portion of said head strap so as to be symmetrical about the longitudinal centerline of a wearer's head.

5. The suspension system of claim 1 wherein said means for connecting said channel to a rear end portion of said shell comprises a pair of spaced apart tabs connected to opposite end portions of said channel, said head strap connecting means comprising a pair of spaced apart tabs connected to a forward end portion of said head strap, each of said pairs being symmetrical about the longitudinal centerline of a wearer's head.

6. The suspension system of claim 1 further comprising a brow pad formed on a forward end portion of said head strap.

7. The suspension system of claim 1 further comprising means for confining said overlapping end portions along said channel.

8. The suspension system of claim 1 further comprising a pair of diagonally extending crown straps adapted to cross one another over a wearer's head, rear end portions of said crown straps being connectable at spaced apart positions to a rear end portion of said shell, which positions are symmetrical about the longitudinal centerline of said shell, forward end portions of said crown straps being connectable at spaced apart positions to a forward end portion of said shell, which latter mentioned positions are symmetrical about the longitudinal centerline of said shell.

9. The suspension system of claim 2 wherein said buckle is manually compressible to unlock said overlapping end portions for permitting adjustment in the length of overlap of said overlapping end portions.

10. The suspension system of claim 3 wherein said tabs are also connected to upper edge portions of said channel and extend upwardly to connect to adjacent surface portions of said shell

11. The suspension system of claim 4 wherein said tabs extend upwardly above said head strap to connect to adjacent surface portions of said shell.

12. The suspension system of claim 5 wherein said channel connected pair of tabs is connected to an upper edge portion of said channel, each of which tabs extend upwardly to connect to adjacent surface portions of said shell, said head strap connected pair of tabs extending upwardly above said head strap to connect to adjacent surface portions of said shell.

13. The suspension system of claim 7 wherein said confining means comprises spaced upper and lower ledges extending parallel to one another along said channel.

14. The suspension system of claim 8 wherein said channel and rear end portions of said crown straps are connected to the same two points on a rear end portion of said shell, said forward end portion of said head strap and the forward end portions of said crown straps being connected to the same two points on a forward end portion of said shell.

15. The suspension system of claim 9 wherein said buckle further comprises a pair of spaced apart, manually compressible, resilient ledges connected on opposite end portions thereof to opposite end portions of said channel, said ledges projecting rearwardly away from said channel end portions and being adapted to confine overlapping end portions of said head strap therebetween, a first flexible, resilient band extending between said ledges and being centered longitudinally along said ledges, said first band being displaced widthwise to one side of the vertical centerline of said ledges, second and third flexible, resilient bands extending between said ledges and being equally spaced longitudinally on opposite sides of said first band, said second and third bands being displaced widthwise to the other side of said vertical centerline, said second and third bands each being approximately one-half as stiff as said first band, each of said bands containing a pin at the same level between said ledges which projects toward said vertical centerline, opposite end portions of said head strap defining a series of equally spaced pin holes therein which are spaced apart by an amount equal to the spacing between successive pairs of said pins, the widthwise spacing between said first band on one side of said vertical centerline and said second and third bands on the other side of said vertical centerline being sufficient to confine overlapping end portions of said head strap therebetween when said ledges are in a relaxed, uncompressed state, and means for vertically centering said overlapping end portions between said ledges such that gaps exist between upper and lower edges of said overlapping end portions and said ledges when said ledges are in a relaxed, uncompressed state, said gaps being reduced when said ledges are compressed toward one another, said bands being adapted to bend outwardly away from said vertical centerline upon compression of said ledges to withdraw said pins from said pin holes to permit manual adjustment of the length of overlap of said overlapping end portions, said pins being adapted to insert into registered ones of said pin holes when compression forces on said ledges are released.

16. The suspension system of claim 15 wherein upper and lower end portions of said bands are angled inwardly toward the vertical centerline of said ledges for assuring that said bands will bend outwardly away from said vertical centerline upon compression of said ledges toward one another.

17. In combination with a safety hat shell, a head band suspension system comprising a head encircling head strap having overlapping rear end portions which define a series of equally spaced pin holes, means for connecting said head strap to said shell, and manually compressible resilient buckle means connected to said head strap for adjusting and maintaining a desired length of overlap of said overlapping end portions, said buckle means containing a series of spaced pins adapted for insertion into selected and registered ones of said pin holes when in a relaxed uncompressed state, said pins being removed from said pin holes when said buckle means is sufficiently compressed for permitting adjustment of the length of overlap of said overlapping end portions.

18. The suspension system of claim 17 wherein said buckle means further comprises a pair of spaced apart, manually compressible, resilient ledges, said overlapping end portions being disposed between said ledges and spaced therefrom when said ledges are in a relaxed, uncompressed state.

19.. The suspension system of claim 18 wherein said buckle means further comprises a first flexible, resilient band extending between said ledges and being centered longitudinally along said ledges, said first band being displaced widthwise to one side of the vertical centerline of said ledges, and second and third flexible resilient bands extending between said ledges and being equally spaced longitudinally on either side of said first band, said second and third bands being displaced widthwise to the other side of said vertical centerline, said second and third bands each being approximately one-half as stiff as said first band, each of said bands containing a pin at the same level between said ledges which projects toward said vertical centerline, successive ones of said pins being spaced apart by an amount equal to the spacing between successive ones of said pin holes, the widthwise spacing between said first band and said second and third bands being sufficient to confine said overlapping end portions therebetween when said ledges are in a relaxed, uncompressed state.

20. The suspension system of claim 19 wherein said buckle means further comprises means for bending said bands away from said overlapping end portions upon compression of said ledges.

21. The suspension system of claim 20 wherein said bending means comprises end portions of said bands which are angled inwardly toward said vertical centerline when said bands are in a relaxed, uncompressed state.

* * * * *